US011105506B2

(12) United States Patent
Dai et al.

(10) Patent No.: US 11,105,506 B2
(45) Date of Patent: Aug. 31, 2021

(54) COMBUSTOR ASSEMBLY AND GAS WATER HEATER

(71) Applicant: WUHU MIDEA KITCHEN AND BATH APPLIANCES MFG. CO., LTD., Wuhu (CN)

(72) Inventors: Xianfeng Dai, Wuhu (CN); Guorong Liang, Wuhu (CN); Chengzhi Xue, Wuhu (CN)

(73) Assignee: WUHU MIDEA KITCHEN AND BATH APPLIANCES MFG. CO., LTD., Wuhu (CN)

( * ) Notice: Subject to any disclaimer, the term of this patent is extended or adjusted under 35 U.S.C. 154(b) by 384 days.

(21) Appl. No.: 16/245,292

(22) Filed: Jan. 11, 2019

(65) Prior Publication Data

US 2019/0195489 A1 Jun. 27, 2019

Related U.S. Application Data

(63) Continuation of application No. PCT/CN2016/113348, filed on Dec. 30, 2016.

(30) Foreign Application Priority Data

Jul. 11, 2016 (CN) ..... 201610540233.X

(51) Int. Cl.
*F23D 14/78* (2006.01)
*F23D 14/08* (2006.01)
(Continued)

(52) U.S. Cl.
CPC ..... *F23D 14/78* (2013.01); *F23C 5/02* (2013.01); *F23D 14/02* (2013.01); *F23D 14/045* (2013.01);
(Continued)

(58) Field of Classification Search
CPC ..... F13D 14/10; F13D 14/26; F13D 14/583; F13D 14/586; F13D 14/02; F23D 14/75;
(Continued)

(56) References Cited

U.S. PATENT DOCUMENTS 6,537,064 B1 * 3/2003 Anderson ..... F23D 14/62 239/432
2011/0256490 A1 * 10/2011 Huang ..... F23D 14/70 431/181
2016/0025373 A1 1/2016 Fujimoto et al.

FOREIGN PATENT DOCUMENTS

CN 201748653 U 2/2011
CN 202660747 U 1/2013
(Continued)

OTHER PUBLICATIONS

OA of JP Application No. 2019-523152.
OA of EP Application No. 16908715.2.
The first OA of Chinese Application No. 201610540233.X.

*Primary Examiner* — Vivek K Shirsat

(57) ABSTRACT

The present disclosure discloses a combustor assembly and a gas water heater, the combustor assembly includes a burner and a combustor accommodating the burner, the combustor defines an opening facing upwards, the combustor further includes a front support and a rear support, and the front support and the rear support cooperatively clamp the front side and the rear side of the burner; the front support includes a first base plate extending up and down and a first limit plate connecting to an upper end of the first base plate and extending backwards, and the rear support includes a second base plate extending up and down and a second limit plate connecting to an upper end of the second base plate and extending forwards; and the first limit plate defines a first cooling hole, and/or, the second limit plate defines a second cooling hole.

16 Claims, 5 Drawing Sheets

(51) Int. Cl.

| | |
|---|---|
| ***F23C 5/02*** | (2006.01) |
| ***F23D 23/00*** | (2006.01) |
| ***F24H 9/18*** | (2006.01) |
| ***F23D 14/04*** | (2006.01) |
| ***F23D 14/02*** | (2006.01) |
| ***F23D 99/00*** | (2010.01) |
| ***F24H 9/00*** | (2006.01) |

(52) U.S. Cl.
CPC ..... *F23D 14/08* (2013.01); *F23D 14/085* (2013.01); *F23D 23/00* (2013.01); *F23D 99/00* (2013.01); *F24H 9/0005* (2013.01); *F24H 9/18* (2013.01); *F24H 9/1836* (2013.01)

(58) Field of Classification Search
CPC ..... F23C 5/02; F24H 1/145; F23L 17/005; F22B 15/00
USPC ..... 431/258, 278, 308, 346, 350, 354
See application file for complete search history.

(56) References Cited

FOREIGN PATENT DOCUMENTS

| | | | |
|---|---|---|---|
| CN | 203024415 | U | 6/2013 |
| CN | 105716080 | A | 6/2016 |
| CN | 205279064 | U | 6/2016 |
| CN | 205351734 | U | 6/2016 |
| CN | 105737151 | A | 7/2016 |
| CN | 106016754 | A | 10/2016 |
| CN | 205878626 | U | 1/2017 |
| JP | H07103423 | A | 4/1995 |
| JP | H09310817 | A | 12/1997 |
| JP | 2000171010 | A | 6/2000 |
| JP | 2005299986 | A | 10/2005 |
| JP | 2010276299 | A | 12/2010 |
| JP | 2011202929 | A | 10/2011 |
| JP | 2015049017 | A | 3/2015 |
| JP | 2016011825 | A | 1/2016 |

* cited by examiner

COMBUSTOR ASSEMBLY AND GAS WATER HEATER

CROSS-REFERENCE TO RELATED APPLICATION

This application is a continuation of International Application No. PCT/CN2016/113348, filed on Dec. 30, 2016, which claims priority to and benefits of Chinese Patent Application Serial No. 201610540233.X, filed with China National Intellectual Property Administration on Jul. 11, 2016, the entire content of which is incorporated herein by reference.

FIELD

The present disclosure generally relates to the field of water heater, and more particularly relates to a combustor assembly and a gas water heater.

BACKGROUND

In order to prevent the burner in the gas water heater from shaking, fixing supports are usually defined at both opposite sides of the burner. The fixing support generally includes a base plate extending up and down, and a limit plate connecting to the base plate and extending towards the burner. The limit plate abuts on a periphery of the burner, and the limit plates of the two fixing supports cooperate to clamp the burner, thereby limiting the burner. As the limit plate abuts on the periphery of the burner, a part of gas tends to accumulate under the limit plate, where there resulting in poor gas fluidity and a high temperature. The heat may be transferred to the outside of the combustor, causing a high temperature of the combustor shell.

SUMMARY

One embodiment of the disclosure to provide a combustor assembly, which aims to reduce the temperatures of the front and rear sides of the combustor.

In order to realize the above aim, the combustor assembly provided by the present disclosure includes a burner and a combustor accommodating the burner, the combustor defines an opening facing upwards, the combustor further includes a front support and a rear support, and the front support and the rear support cooperatively clamp the front side and the rear side of the burner; the front support includes a first base plate extending up and down and a first limit plate connecting to an upper end of the first base plate and extending backwards, and the rear support includes a second base plate extending up and down and a second limit plate connecting to an upper end of the second base plate and extending forwards; and the first limit plate defines a first cooling hole, and/or, the second limit plate defines a second cooling hole.

In one embodiment, the first limit plate and the second limit plate are positioned to be lower than an ignition device of the burner.

In one embodiment, the first cooling hole is defined at the adjoiner of the first base plate and the first limit plate; and the second cooling hole is defined at the adjoiner of the second base plate and the second limit plate.

In one embodiment, the first cooling hole is a strip-shaped hole extending along the left-right direction; and the second cooling hole is a strip-shaped hole extending along the left-right direction.

In one embodiment, the front support further includes a support plate for supporting the burner, the lower end of the first base plate connects to the support plate, the bottom surface of the support plate defines a leg located at the bottom wall of the combustor, and the support plate defines a first air inlet hole.

In one embodiment, the burner includes a plurality of heat exchange plates spaced from each other, and the first air inlet hole is configured to correspond to a gap between two adjacent heat exchange plates.

In one embodiment, the first base plate has a stepped structure, and includes a first section and a second section arranged up and down, and the first section protrudes outwards from the second section to form a step surface between the first section and the second section; the first limit plate connects to the first section, the support plate connects to the second section, and the step surface defines a second air inlet hole.

In one embodiment, the combustor assembly further includes an air plate located outside the second section, the air plate extends downwards to be below the support plate, and the portion of the air plate exposed from the support plate defines an air inlet.

In one embodiment, the rear support further includes a third limit plate abutting the rear side of the burner, the lower end of the second base plate connects to the third limit plate, the third limit plate is defined above the support plate, and the third limit plate defines a third cooling hole.

The present disclosure further provides a gas water heater, the gas water heater includes a combustor assembly which includes a burner and a combustor accommodating the burner, the combustor defines an opening facing upwards, and, the combustor further includes a front support and a rear support, and the front support and the rear support cooperatively clamp the front side and the rear side of the burner; the front support includes a first base plate extending up and down and a first limit plate connecting to an upper end of the first base plate and extending backwards, and the rear support includes a second base plate extending up and down and a second limit plate connecting to an upper end of the second base plate and extending forwards; and the first limit plate defines a first cooling hole, and/or, the second limit plate defines a second cooling hole.

In the present disclosure, as the first limit plate defines the first cooling hole, the second limit plate defines the second cooling hole, so that when the gas moves below the first limit plate and the second limit plate, the gas can run out along the first cooling hole and the second cooling hole, thus enhancing the fluidity of the gas and avoiding gas accumulation, and the flowing gas can further take away part of the heat at the front and rear sides, which is beneficial to cool the shell of the combustor.

BRIEF DESCRIPTION OF THE DRAWINGS

Various embodiments according to this disclosure are described in the accompanying drawings are intended for the description of the embodiments herein will now be briefly described, it is evident that the accompanying drawings listed in the following description show merely some embodiments according to this disclosure.

Labels illustration for drawings.

Figure 1:
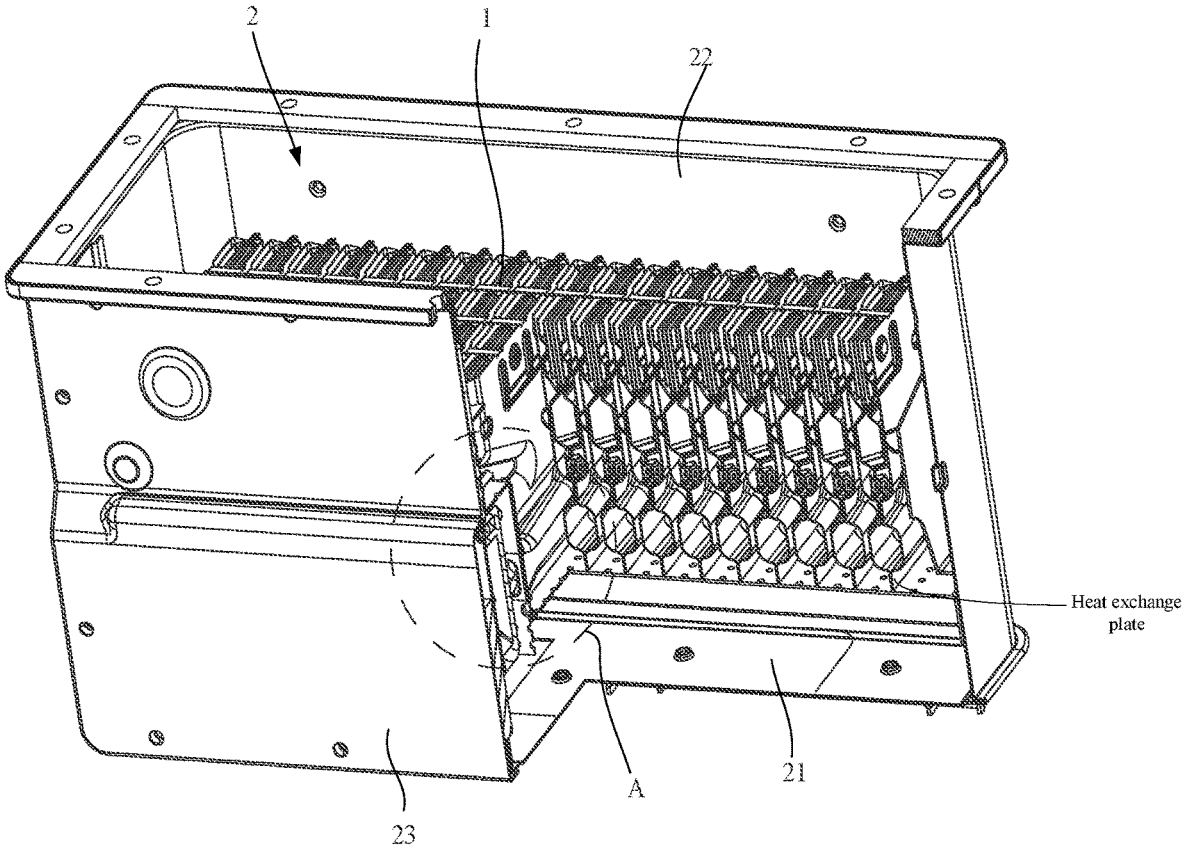
FIG. 1 is a structural diagram of the combustor assembly of the present disclosure according to an exemplary embodiment.

| Label | Name |
|---|---|
| 1 | burner |
| 2 | combustor assembly |
| 21 | bottom plate |
| 22 | enclosure plate |
| 23 | cover plate |
| 3 | front support |
| 31 | first base plate |
| 311 | first section |
| 312 | second section |
| 3121 | third air inlet hole |
| 313 | step surface |
| 3131 | second air inlet hole |
| 314 | reinforcing rib |
| 32 | first limit plate |
| 321 | first cooling hole |
| 33 | support plate |
| 331 | first air inlet hole |
| 34 | leg |
| 4 | rear support |
| 41 | second base plate |
| 42 | second limit plate |
| 421 | second cooling hole |
| 43 | third limit plate |
| 431 | third cooling hole |
| 44 | side wing |
| 441 | support foot |
| 5 | air plate |
| 51 | main air inlet hole |
| 52 | auxiliary air inlet hole |
| 6 | gas ejector pipe assembly |

DETAILED DESCRIPTION

Embodiments of the present disclosure will be described in the following with reference to the accompanying drawings. The embodiments to be described are only a part rather than all of the embodiments of the present disclosure.

It is to be understood that, all of the directional instructions in the exemplary embodiments of the present disclosure (such as top, down, left, right, front, back . . . ) can only be used for explaining relative position relations, moving condition of the elements under a form (referring to figures), and so on, if the form changes, the directional instructions changes accordingly.

Embodiments of the present disclosure will be in the following with reference to the drawings in the embodiment of the present disclosure.

It should be noted that if directional indications (such as up, down, left, right, front, back, etc.) are involved in the embodiments of the present disclosure, the directional indications are only used to explain the relative positional relationship and movement between the components in a certain posture (as shown in the drawings), and if the specific posture changes, the directional indications will change accordingly.

In addition, if there are descriptions of "first" and "second" in the embodiments of the present disclosure, the descriptions of "first" and "second" are for descriptive purposes only and cannot be understood as indicating or implying their relative importance or implicitly indicating the number of indicated features. Thus, features defining "first" and "second" may explicitly or implicitly include at least one such feature disclosure The present disclosure provides a gas water heater, which includes a combustor assembly.

In an embodiment of the present disclosure, as shown in FIG. 1, the combustor assembly includes a burner 1 and a combustor 2 for accommodating the burner 1, the combustor 2 defines an opening facing upwards. The combustor 2 includes a bottom plate 21, and three enclosure plates 22 and a cover plate 23 surrounding the periphery of the bottom plate, and the bottom plate 21, the enclosure plates 22, and the cover plate 23 cooperatively form a cavity with the upward opening.

Figure 3:
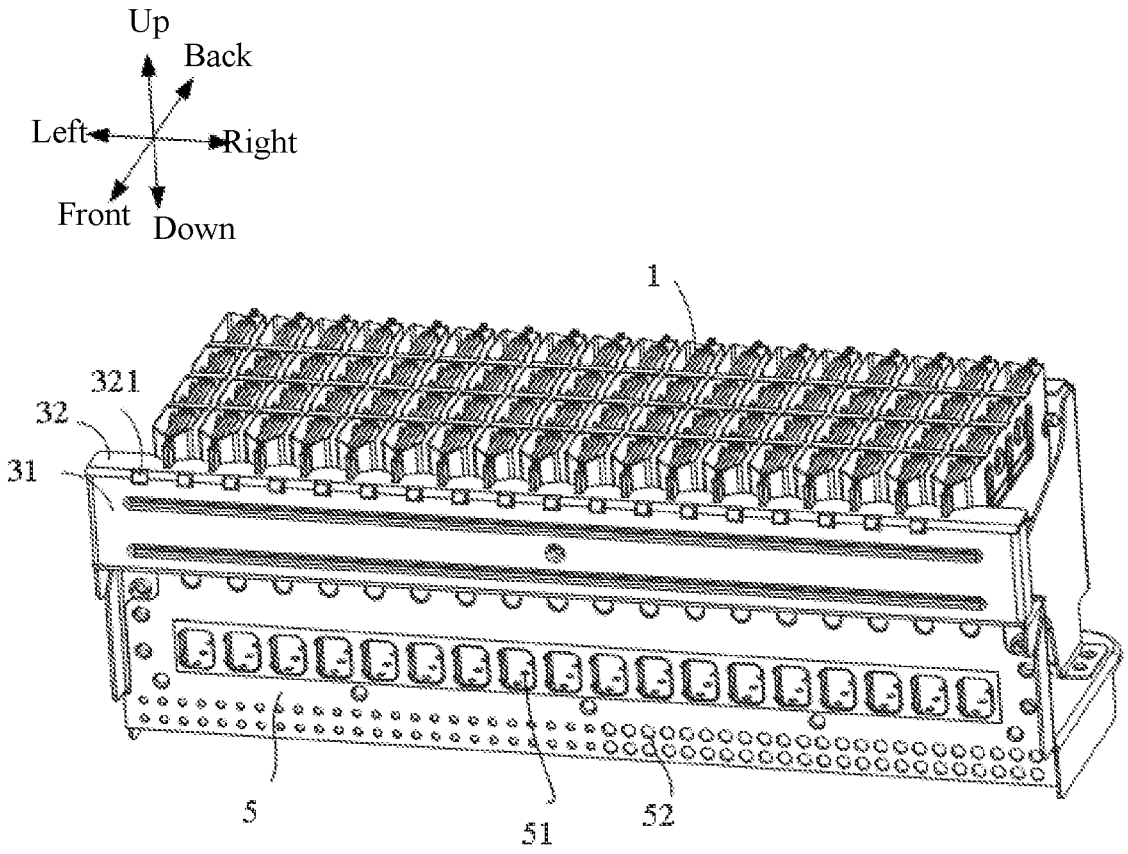
FIG. 3 is a structural diagram of the front support, the rear support, and the burner, shown in FIG. 1, which are assembled together.
Figure 4:
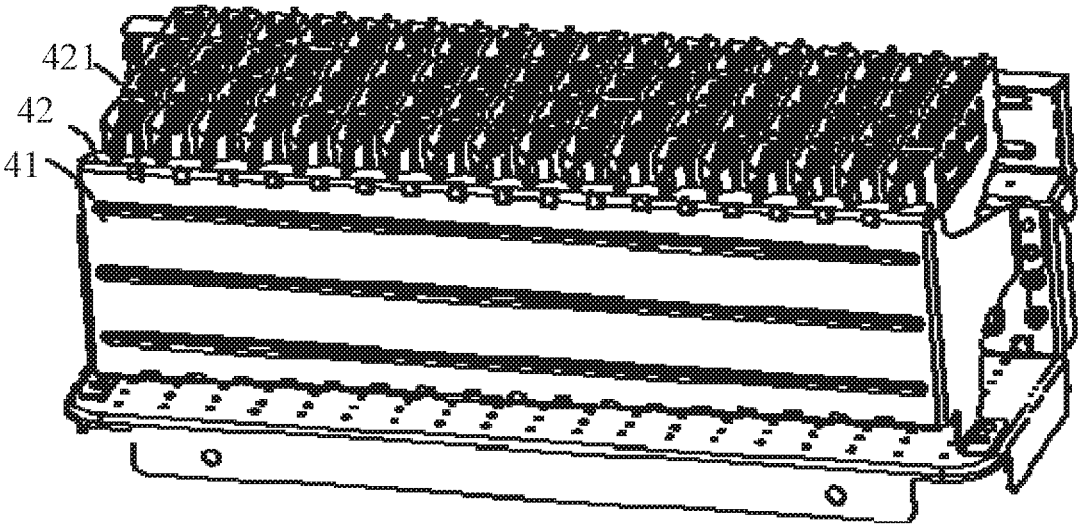
FIG. 4 is a structural diagram of the front support, the rear support, and the burner in FIG. 3, but shown from another angle.
Figure 5:
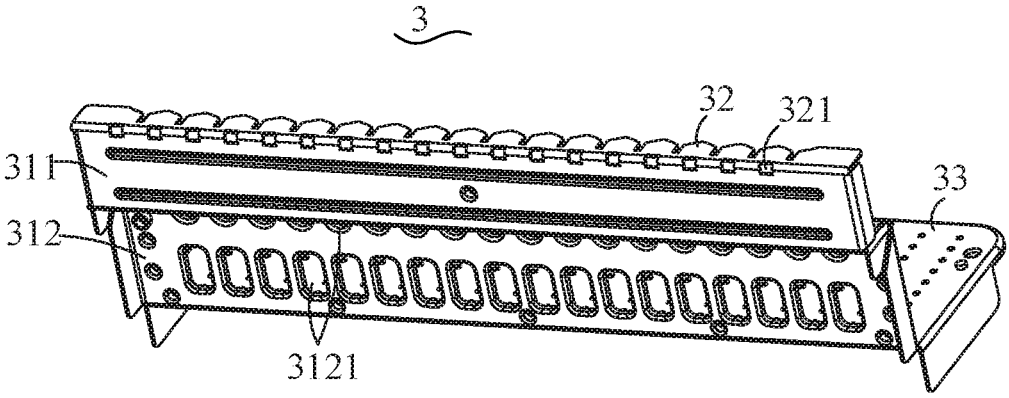
FIG. 5 is a structural diagram of the front support shown in FIG. 1.
Figure 7:
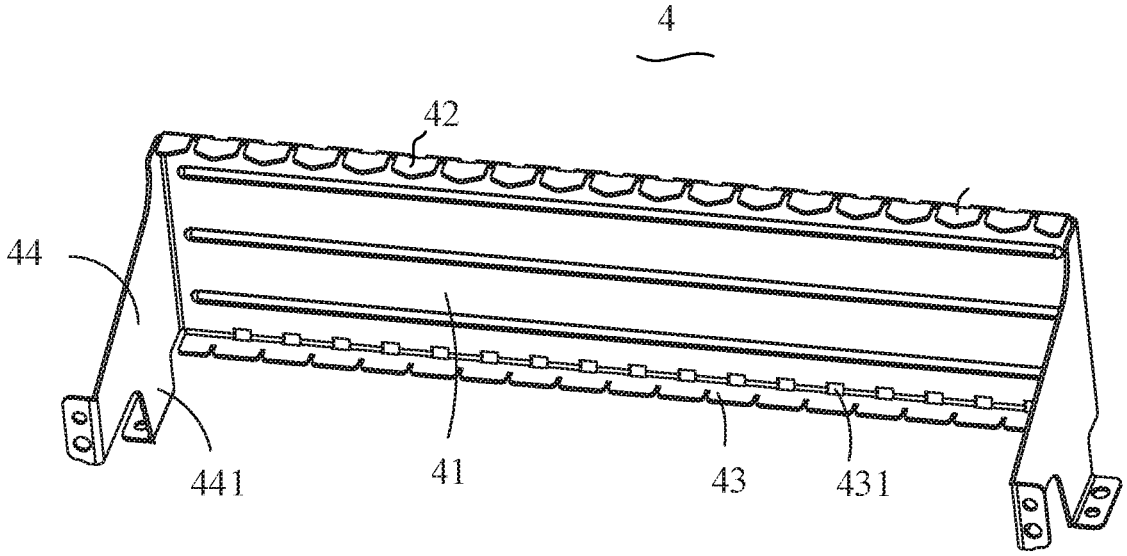
FIG. 7 is a structural diagram of the rear support shown in FIG. 1.

As shown in FIGS. 3 and 4, in order to prevent the burner 1 from shaking, a front support 3 (as shown in FIG. 5) and a rear support 4 (as shown in FIG. 7) are also provided in the combustor 2, and the front support 3 and the rear support 4 cooperatively clamp the front and rear sides of the burner 1. The front support 3 includes a first base plate 31 extending up and down, and a first limit plate 32 connecting to the upper end of the first base plate 31 and extending backwards. The rear support 4 includes a second base plate 41 extending up and down, and a second limit plate 42 connecting to the upper end of the second base plate 41 and extending forwards. The first limit plate 32 defines a first cooling hole 321; and/or, the second limit plate 42 defines a second cooling hole 421.

The burner 1 generally includes a plurality of heat exchangers which are arranged side by side and spaced from each other along the left-right direction, and the free end faces of the first limit plate 32 and the second limit plate 42 are provided with a plurality of grooves for correspondingly engaging with the heat exchangers, so as to limit the shaking of the heat exchangers along the left-right and front-back directions.

The first limit plate 32 connects to the upper end of the first base plate 31, the first limit plate 32 may either connect to the top end of the first base plate 31, or may be adjacent to and connect to the top end of the first base plate 31. The second limit plate 42 connects to the upper end of the second base plate 41, the second limit plate 42 may either connect to the top end of the second base plate 41, or may be adjacent to and connect to the top end of the second base plate 41.

In the present disclosure, since the first limit plate 32 defines the first cooling hole 321, and the second limit plate 42 defines the second cooling hole 421, when the gas moves below the first limit plate 32 and the second limit plate 42, the gas can run out along the first cooling hole 321 and the second cooling hole 421, thereby enhancing the gas fluidity and avoiding gas accumulation, and the flowing gas can take away part of the heat at the front and rear sides, which is beneficial to cool the shell of the combustor 2.

In one embodiment, the first limit plate 32 and the second limit plate 42 are positioned to be lower than an ignition device of the burner. In this way, the gas discharged through the first cooling hole 321 and the second cooling hole 421 is unburned gas, and the temperature of the gas itself is lower than the temperature of the flue gas after combustion, so that the gas can absorb more heat from the front and rear sides of the combustor 2, and can take away heat to achieve a better cooling effect.

Since a dead angle is easily formed between the two adjacent plates, and the gas mobility at the dead angle is poor, in order to avoid the generation of the dead angle at the adjacent position and improve the gas flow performance at the position to achieve a better cooling effect, in one embodiment, the first cooling hole 321 is defined at the adjoiner of the first base plate 31 and the first limit plate 32; and the second cooling hole 421 is defined at the adjoiner of the second base plate 41 and the second limit plate 42. In this way, the gas located below the adjoiner can be quickly discharged from the cooling hole, thereby avoiding the accumulation of gas at the adjoiner.

In order to increase the air outlet area of the cooling hole, it may be necessary that the first cooling hole 321 is a strip-shaped hole extending along the left-right direction, and the second cooling hole 421 is also a strip-shaped hole extending along the left-right direction. In one embodiment, the first cooling hole 321 and the second cooling hole 421 may be rectangular holes, or elliptical holes, etc. Of course, the first cooling hole 321 and the second cooling hole 421 may also be round holes, square holes, or other irregular holes. In the embodiment, the strip-shaped hole extends along the adjoiner of the two plates, so that the gas at the adjoiner can be quickly discharged to achieve a better cooling effect.

There are a plurality of first cooling holes 321, and the plurality of first cooling holes 321 are spaced from each other along the left-right direction; there are a plurality of second cooling holes 421, and the plurality of second cooling holes 421 are spaced from each other along the left-right direction. In the embodiment, the first cooling holes 321 and the second cooling holes 421 are uniformly arranged, which is more conducive to uniform exhaust, thereby achieving uniform cooling. By providing the plurality of the first cooling holes 321 and the plurality of the second cooling holes 421, the gas circulation speed can be increased.

In other embodiments, the first cooling holes 321 are all located in the first limit plate 32 and vertically run through the first limit plate 32; the second cooling holes 421 are all located in the second limit plate 42 and vertically run through the second limit plate 42.

In general, the air can flow into the combustor 2 from the side or from the bottom of the combustor 2. For example, in one embodiment, the air can flow into the combustor 2 from the side, that is, a gas ejector pipe assembly 6 for injecting air into the combustor 2 is provided on the side wall of the combustor 2, and the front support 3 defines an inlet hole communicating with the gas ejector pipe assembly 6, so that gas can flow from the inlet hole to the heat exchanger and burn near the ignition device.

Figure 2:
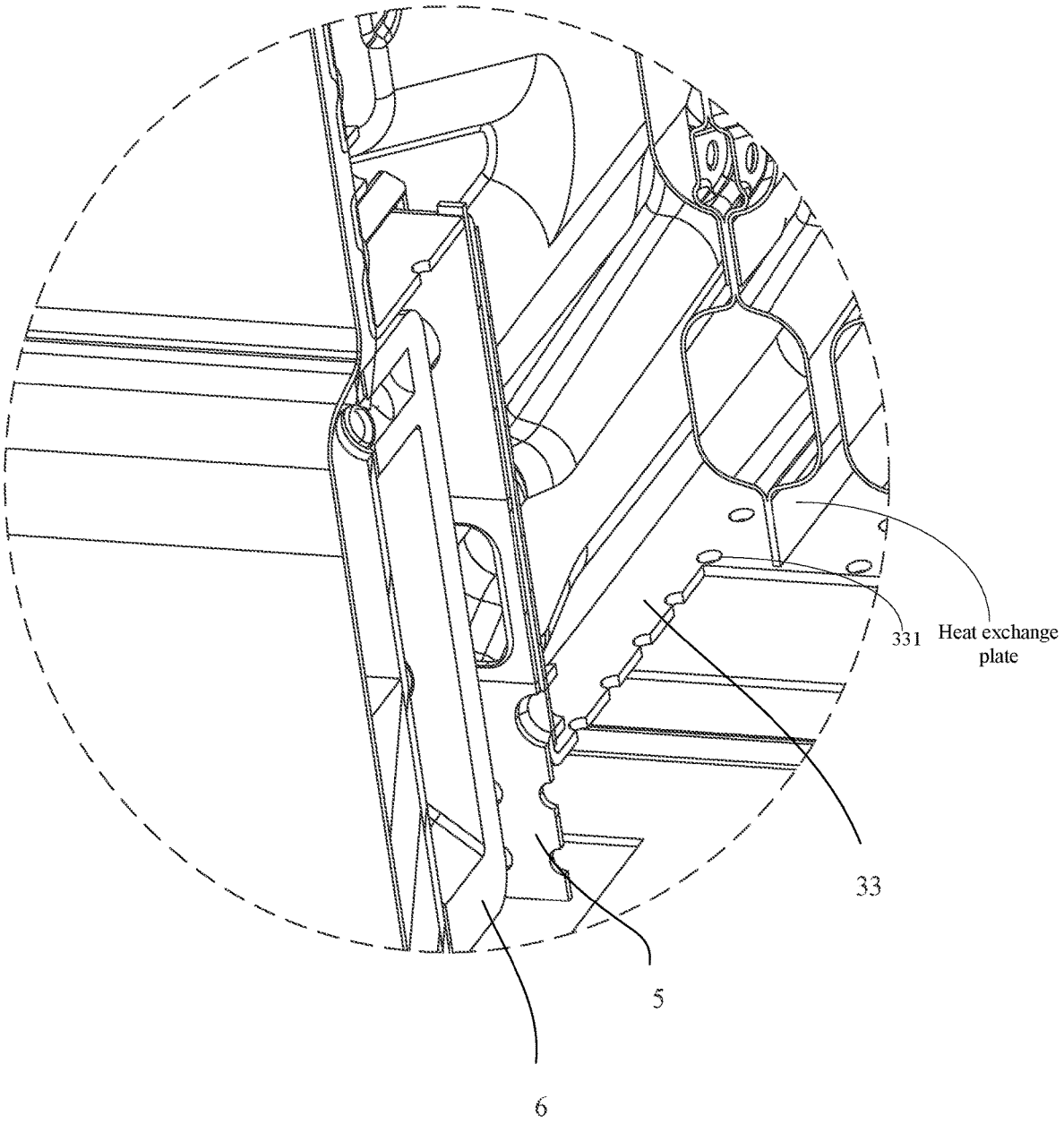
FIG. 2 is an enlarged diagram of portion A shown in FIG. 1.
Figure 6:
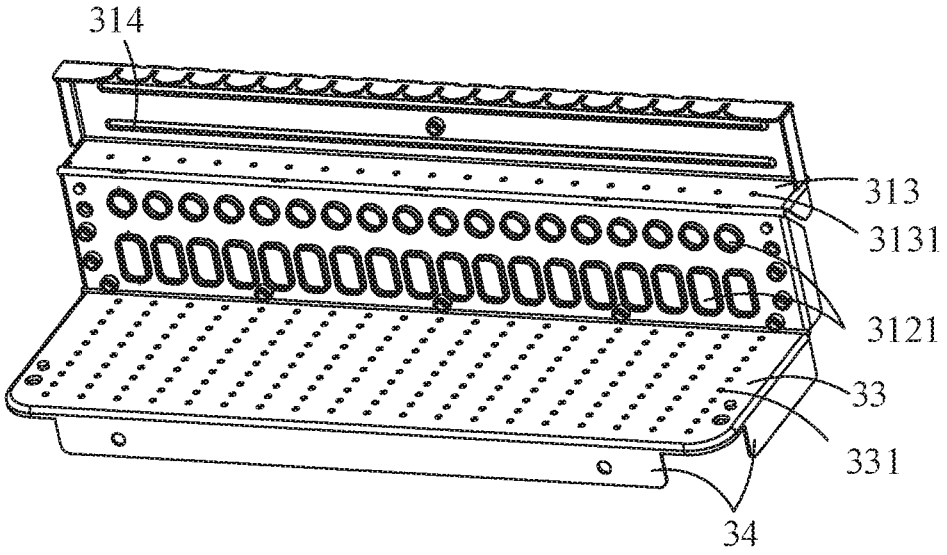
FIG. 6 is a structural diagram of the front support in FIG. 5, but shown from another angle.

As shown in FIGS. 5 and 6, In one embodiment, the first base plate 31 of the front support 3 defines a plurality of rows of third air inlet holes 3121 which are spaced from each other along the up-down direction, and each row includes a plurality of third air inlet holes 3121 which are spaced from each other along the left-right direction. The third air inlet hole 3121 serves as the main air inlet hole and communicates with the air-gas ejector pipe assembly 6 (as shown in FIG. 2).

Furthermore, the front support 3 also includes a support plate 33 for supporting the burner 1, the lower end of the first base plate 31 connects to the support plate 33, the bottom surface of the support plate 33 defines a leg 34 located at the bottom wall of the combustor 2, and the support plate 33 defines a first air inlet hole 331. In the embodiment, the first air inlet hole 331 serves as auxiliary air inlet hole and communicates with the gas ejector pipe assembly 6. In one embodiment, the aperture of the first air inlet hole 331 is smaller than the aperture of the third air inlet hole 3121. On the basis of the side-entry third air inlet hole 3121, the bottom-entry is realized by setting the first air inlet hole 331, which can increase more air inlet channels, further supplying air for the combustion of the burner 1, and ensuring more sufficient combustion of the gas, thereby contributing to reducing the content of nitrogen oxides in the flue gas.

In this embodiment, the first air inlet hole 331 is configured to correspond to the gap between two adjacent heat exchange plates. That is, each gap is provided with the first air inlet hole 331, air can be supplied for the combustion of the gas on each heat exchange plate, so that the gas on each heat exchange plate can be fully combusted. In one embodiment, the plurality of the first air inlet hole 331 are uniformly arranged.

In the above embodiments, the support plate 33 is folded down to form a flanging which is defined as the leg 34. In the embodiment, the left and right sides and the rear side of the support plate 33 are all folded to form the legs 34, so that there is a gap between the support plate 33 and the bottom wall of the combustor 2, thereby providing a passage for gas to enter the first air inlet hole 331 from bottom to top. In other embodiments, the leg 34 may also be a support post formed on the bottom surface of the support plate 33.

In one embodiment, the first base plate 31 has a stepped structure, and includes a first section 311 and a second section 312 arranged up and down, the first section 311 protrudes outwards from the second section 312 to form a step surface 313 between the first section 311 and the second section 312. The first limit plate 32 connects to the first section 311, the support plate 33 connects to the second section 312, the step surface 313 defines the second air inlet hole 3131, and the second air inlet hole 3131 communicates with the gas ejector pipe assembly 6. In the embodiment, there are a plurality of second air inlet holes 3131, and the second air inlet holes 3131 are spaced from each other and evenly arranged along the left-right direction. The aperture of the second air inlet hole 3131 is smaller than the aperture of the third air inlet hole 3121, and the second air inlet hole 3131 serves as the auxiliary air inlet passage, so that gas can move along the second air inlet hole 3131 from bottom to top to the vicinity of the ignition device, to further supply air for gas combustion. At the same time, since the second air inlet hole 3131 is located below the first limit plate 32 and has a smaller horizontal distance from the first cooling hole 321, that is, the inclination angle of the connecting line between the second air inlet hole 3131 and the first cooling hole 321 relative to the vertical direction is smaller, as such much more gas passing through the second air inlet hole 3131 can be discharged directly from the first cooling hole 321 quickly. Since gas passing through the second air inlet hole 3131 moves from bottom to top, the upward moving gas can have a certain impact on the gas below the adjoiner of the first limit plate 32 and the first base plate 31, so as to better discharge the gas below the adjoiner of the first limit plate 32 and avoid gas accumulation.

Referring to FIG. 3, furthermore, the combustor assembly further includes an air plate 5 disposed outside the second section 312, and the air plate 5 extends downwards to be below the support plate 33. The air plate 5 is disposed outside the second section 312, which can prevent the air plate 5 from protruding outside the first base plate 31 and affecting the adhesion of the first base plate 31 to the side wall of the combustor 2. The portion of the air plate 5 exposed from the support plate 33 defines an air inlet, which is defined as an auxiliary air inlet 52, and the auxiliary air inlet 52 communicates with the first air inlet hole 331. The air plate 5 is also provided with a main air inlet 51 which is located above the support plate 33 and configured to correspond to the third air inlet hole 3121. The auxiliary air inlet 52 and the main air inlet 51 are respectively communicated with the gas ejector pipe assembly 6, and the first air inlet hole 331 and the third air inlet hole 3121 are both communicated with the gas ejector pipe assembly 6 through the air plate 5. In this embodiment, there are a plurality of auxiliary air inlets 52, and the plurality of auxiliary air inlets 52 are evenly spaced from each other along the left-right direction. The aperture of the auxiliary air inlet 52 is smaller than the aperture of the main air inlet 51, and the apertures of the auxiliary air inlets 52 may be the same or different. The auxiliary air inlets 52 can play a role of uniformly distributing the gas, so that the gas entering under the support plate 33 can be relatively dispersed, thereby the gas can flow upward from each of the first air inlet hole 331 more uniformly.

Referring to FIG. 7, in order to further improve the limit effect on the burner 1, in one embodiment, the rear support 4 further includes a third limit plate 43 abutting the rear side of the burner 1, the lower end of the second base plate 41 connects to the third limit plate 43, and the third limit plate 43 is located above the support plate 33. In order to enhance the gas fluidity above the adjoiner of the third limit plate 43 and the second base plate 41, the third limit plate 43 defines a third cooling hole 431. In one embodiment, the third cooling hole 431 is located at the adjoiner of the third limit plate 43 and the second base plate 41, and the shape and arrangement of the third cooling hole 431 are the same as these of the second cooling holes 421, and would not be described here. Since the third limit plate 43 is located above the support plate 33, the gas entering from the first air inlet hole 331 of the support plate 33 can flow into the third cooling hole 431, thereby improving the gas fluidity above the third limit plate 43.

In one embodiment, the left and right sides of the second base plate 41 respectively extend forwards to form two side wings 44, the two side wings 44 abut the first base plate 31 and are mounted on the first base plate 31 to clamp the burner 1. Each of the side wings 44 extends downwards to form a support foot 441, the support foots 441 abut the support plate 33 and are mounted on the support plate 33.

As shown in FIG. 6, the first section 311 of the first base plate 31 defines a plurality of reinforcing ribs 314 which extend along the left-right direction, the reinforcing ribs 314 can reinforce the first base plate 31 and prevent the first base plate 31 from being squeezed and deformed by the reaction force of the burner 1. In the embodiment, if a part of the front surface of the first section 311 is recessed toward the rear surface, a protruding portion is formed on the rear surface, the protruding portion is defined as the reinforcing rib 314. Similarly, the front surface of the second base plate 41 also defines the reinforcing rib 314.

What is claimed is:

1. A combustor assembly, comprising:

a burner and a combustor accommodating the burner, the combustor defining an opening facing upwards, wherein, the combustor further comprises a front support and a rear support, and the front support and the rear support cooperatively clamp the front side and the rear side of the burner;

the front support comprises a first base plate extending up and down, and a first limit plate connecting to an upper end of the first base plate and extending backwards, and the rear support comprises a second base plate extending up and down and a second limit plate connecting to an upper end of the second base plate and extending forwards; and the first limit plate defines a first cooling hole, and/or, the second limit plate defines a second cooling hole;

wherein the front support further comprises a support plate for supporting the burner, the lower end of the first base plate connects to the support plate, the bottom surface of the support plate defines a leg located at the bottom wall of the combustor, and the support plate defines a first air inlet hole;

wherein the rear support further comprises a third limit plate abutting the rear side of the burner, the lower end of the second base plate connects to the third limit plate, the third limit plate is defined above the support plate, and the third limit plate defines a third cooling hole.

2. The combustor assembly according to claim 1, wherein, the first limit plate and the second limit plate are positioned to be lower than an ignition device of the burner.

3. The combustor assembly according to claim 2, wherein the first cooling hole is defined at the adjoiner of the first base plate and the first limit plate; and the second cooling hole is defined at the adjoiner of the second base plate and the second limit plate.

4. The combustor assembly according to claim 3, wherein the first cooling hole is a strip-shaped hole extending along the left-right direction; and the second cooling hole is a strip-shaped hole extending along the left-right direction.

5. The combustor assembly according to claim 4, wherein there are a plurality of first cooling holes, and the plurality of first cooling holes are spaced from each other along the left-right direction; and there are a plurality of the second cooling holes, and the plurality of second cooling holes are spaced from each other along the left-right direction.

6. The combustor assembly according to claim 1, wherein the burner comprises a plurality of heat exchange plates spaced from each other, and the first air inlet hole is configured to correspond to a gap between two adjacent heat exchange plates.

7. The combustor assembly according to claim 1, wherein the first base plate has a stepped structure, and comprises a first section and a second section arranged up and down, and the first section protrudes outwards from the second section to form a step surface between the first section and the second section; the first limit plate connects to the first section, the support plate connects to the second section, and the step surface defines a second air inlet hole.

8. The combustor assembly according to claim 7, wherein the combustor assembly further comprises an air plate located outside the second section, the air plate extends downwards to be below the support plate, and the portion of the air plate exposed from the support plate defines an air inlet.

9. A gas water heater, wherein, the gas water heater comprises:

a combustor assembly, the combustor assembly comprises a burner and a combustor accommodating the burner, the combustor defines an opening facing upwards, the combustor further comprises a front support and a rear support, and the front support and the rear support cooperatively clamp the front side and the rear side of the burner;

the front support comprises a first base plate extending up and down and a first limit plate connecting to an upper end of the first base plate and extending backwards, and the rear support comprises a second base plate extending up and down and a second limit plate connecting to an upper end of the second base plate and extending forwards; and the first limit plate defines a first cooling hole, and/or, the second limit plate defines a second cooling hole;

wherein the front support further comprises a support plate for supporting the burner, the lower end of the first base plate connects to the support plate, the bottom surface of the support plate defines a leg located at the bottom wall of the combustor, and the support plate defines a first air inlet hole;

wherein the rear support further comprises a third limit plate abutting the rear side of the burner, the lower end of the second base plate connects to the third limit plate, the third limit plate is defined above the support plate, and the third limit plate defines a third cooling hole.

10. The gas water heater according to claim 9, wherein the first limit plate and the second limit plate are positioned to be lower than an ignition device of the burner.

11. The gas water heater according to claim 10, wherein the first cooling hole is defined at the adjoiner of the first base plate and the first limit plate; and the second cooling hole is defined at the adjoiner of the second base plate and the second limit plate.

12. The gas water heater according to claim 11, wherein the first cooling hole is a strip-shaped hole extending along the left-right direction; and the second cooling hole is a strip-shaped hole extending along the left-right direction.

13. The gas water heater according to claim 12, wherein there are a plurality of first cooling holes, and the plurality of first cooling holes are spaced from each other along the left-right direction; and there are a plurality of the second cooling holes, and the plurality of second cooling holes are spaced from each other along the left-right direction.

14. The gas water heater according to claim 9, wherein the burner comprises a plurality of heat exchange plates spaced from each other, and the first air inlet hole is configured to correspond to a gap between two adjacent heat exchange plates.

15. The gas water heater according to claim 9, wherein the first base plate has a stepped structure, and comprises a first section and a second section arranged up and down, and the first section protrudes outwards from the second section to form a step surface between the first section and the second section; the first limit plate connects to the first section, the support plate connects to the second section, and the step surface defines a second air inlet hole.

16. The gas water heater of claim 15, wherein the combustor assembly further comprises an air plate located outside the second section, the air plate extends downwards to be below the support plate, and the portion of the air plate exposed from the support plate defines an air inlet.

* * * * *